US011952838B2

(12) United States Patent
Lanzl et al.

(10) Patent No.: US 11,952,838 B2
(45) Date of Patent: Apr. 9, 2024

(54) DEVICE FOR CLEARING A HELIX GAP OF AN AUGER, AND METHOD FOR MAKING A DRILLED HOLE

(71) Applicant: BAUER Maschinen GmbH, Schrobenhausen (DE)

(72) Inventors: Martin Lanzl, Ingolstadt (DE); Stefan Bachhuber, Waidhofen (DE); Ralf Oehme, Ingolstadt (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 18/040,119

(22) PCT Filed: Jul. 27, 2021

(86) PCT No.: PCT/EP2021/071018
§ 371 (c)(1),
(2) Date: Jan. 31, 2023

(87) PCT Pub. No.: WO2022/028955
PCT Pub. Date: Feb. 10, 2022

(65) Prior Publication Data

US 2023/0265720 A1 Aug. 24, 2023

(30) Foreign Application Priority Data

Aug. 5, 2020 (EP) ..... 20189666

(51) Int. Cl.
*E21B 12/06* (2006.01)

(52) U.S. Cl.
CPC ..... *E21B 12/06* (2013.01)

(58) Field of Classification Search
CPC ..... E21B 12/06; E21B 7/005; E21B 7/006; E21B 10/44
See application file for complete search history.

(56) References Cited

U.S. PATENT DOCUMENTS 3,581,833 A * 6/1971 Hennecke ..... E21B 12/06 175/84
4,650,012 A * 3/1987 Bollinger ..... E21B 12/06 175/84

(Continued)

FOREIGN PATENT DOCUMENTS

CN 111236862 A 6/2020
DE 34 46 902 A1 7/1986

(Continued)

OTHER PUBLICATIONS

International Preliminary Report on Patentability and Written Opinion issued in PCT/EP2021/071018; dated Feb. 7, 2023.

(Continued)

*Primary Examiner* — Kipp C Wallace
(74) *Attorney, Agent, or Firm* — Studebaker & Brackett PC

(57) ABSTRACT

The invention relates to a device for clearing a helix gap of an auger, comprising a retainer for holding the device on a mast of a drill, a guide tube which surrounds the auger in portions and is mounted on the retainer, and a clearing element which engages in the helix gap and is mounted on the retainer so as to be freely rotatable about the drilling axis. According to the invention it is provided for the guide tube to be mounted on the retainer so as to be freely rotatable about the drilling axis, for the clearing element to be firmly attached to the rotatably mounted guide tube, for the guide tube to be axially fixed in the direction of the drilling axis, for the purpose of clearing, and for the clearing element, together with the guide tube, to be able to be caused to rotate about the drilling axis by means of a pulling procedure of the auger for the purpose of clearing the auger. The invention further relates to a method for making a drilled hole in the (Continued)

Figure 1:
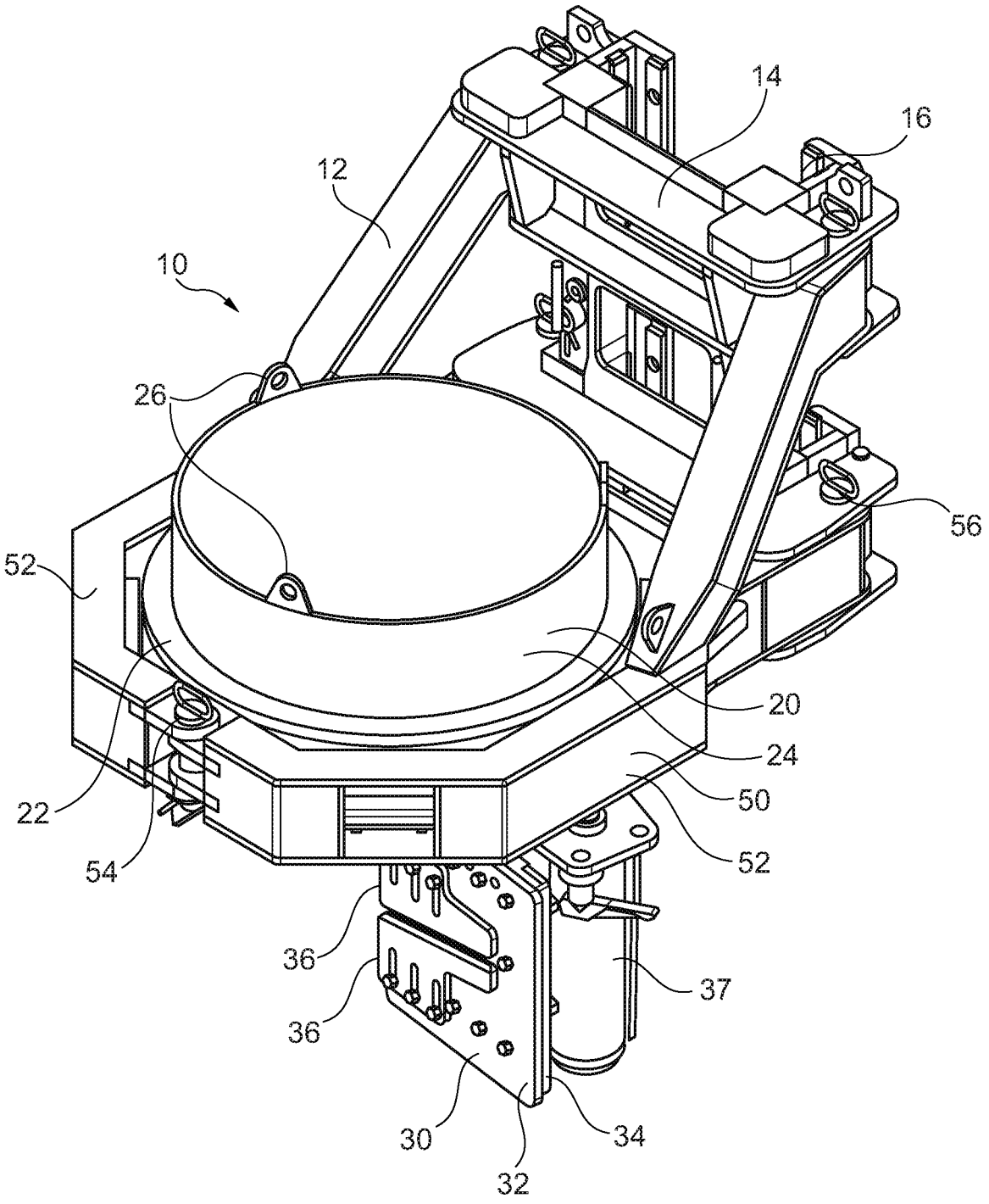

ground using a drill, wherein the device according to the invention is used.

11 Claims, 3 Drawing Sheets

(56) References Cited

U.S. PATENT DOCUMENTS

| | | | | |
|---|---|---|---|---|
| 10,024,115 | B1 * | 7/2018 | Bollman | E21B 10/44 |
| 10,315,856 | B2 * | 6/2019 | Jöchner | B65G 33/18 |
| 2015/0176337 | A1 * | 6/2015 | Ditillo | E21B 7/005 175/84 |
| 2022/0341264 | A1 * | 10/2022 | Heichel | E21B 3/022 |

FOREIGN PATENT DOCUMENTS

| | | | |
|---|---|---|---|
| EP | 0 744 525 | B1 | 8/1999 |
| EP | 1 081 329 | B1 | 12/2004 |
| EP | 2 749 729 | A1 | 7/2014 |
| FR | 2609307 | A1 | 7/1988 |
| SU | 705099 | A1 | 12/1979 |

OTHER PUBLICATIONS

International Search Report issued in PCT/EP2021/071018; dated Oct. 11, 2021.

* cited by examiner

DEVICE FOR CLEARING A HELIX GAP OF AN AUGER, AND METHOD FOR MAKING A DRILLED HOLE

The invention relates to a device for clearing a helix gap of an auger, comprising a retainer for holding the device on the mast of a drill, a guide tube which surrounds the auger in portions and is mounted on the retainer, and a clearing element which engages in the helix gap and is mounted on the retainer so as to be rotatable about a drilling axis, according to the preamble of claim 1.

The invention further relates to a method for making a drilled hole in the ground using a drill, wherein an auger for forming the drilled hole is screwed into the ground and subsequently withdrawn again, according to the preamble of claim 11.

When making a drilled hole in the ground, in particular in the case of a cohesive ground material, it is frequently necessary to remove ground material, remaining on the drill helixes, after pulling the auger. For such clearing of the drill helix gaps, and cleaning of remaining ground material from the auger, it is known to provide a clearing device on a drill.

In the case of a simple design, the clearing device comprises a stationary guide tube, on which, in order to clear a helix gap, a clearing plate can be pivoted into said gap. A matched rotary and pulling movement of the auger makes it possible for remaining ground material to thus be eliminated from the helix gaps by means of the clearing plate.

A clearing device of this kind emerges for example from DE 34 46 902 A1.

Furthermore, a clearing device comprising an impeller-like clearing element is known from EP 1 081 329 B1. Said impeller-like clearing element is in meshing connection with the helixes of the drill, in order to engage in the helix gaps and clean these of remaining ground material.

A drill comprising a clearing device is known from EP 2 749 729 A1, in which the clearing element is mounted so as to be rotatable about the auger and is driven by a rotating motor. A rotating drive of the clearing element makes it possible for said element to revolve around the auger, and thus to free the helix gaps of remaining ground material in the case of a matched pulling movement of the auger. However, for an arrangement of this kind, a supply of energy via hydraulic lines or electrical lines is required, which is associated with increased effort. The guidance of energy lines in the region close to the bore, at which a clearing device is in principle located, is subjected to an increased risk of damage during operation. Furthermore, the rotary movement of the clearing element by the rotating motor and the pulling movement of the auger are to be exactly matched to one another, since otherwise there is a threat of damage to the clearing element and the auger.

A generic clearing device is known from EP 0 744 525 B1. Said clearing device comprises a retainer having a guide tube firmly attached thereto. A clearing device is mounted on an underside of the guide tube, by means of an axial bearing, so as to be freely rotatable about the drilling axis, such that the clearing device can revolve about the drilling axis.

For clearing using said device, it is provided to first move this to an upper end region of the mast, such that the clearing device, on account of its dead weight, can move downwards when the auger is pulled. As a result, the clearing means engaging in the helix gap can travel in a helical manner in the helix gap, and thus strip off remaining ground material. In the case of this arrangement, the provided axial bearing is subjected not only to axial forces but also to significant transverse forces, as a result of which the functionality and the service life of the axial bearing and the arrangement as a whole is impaired.

The object of the invention is to specify a device for clearing a helix gap of an auger, and a method for this purpose, by means of which clearing of the helix gaps of an auger can be carried out in a simple and reliable manner.

The object is achieved according to the invention on the one hand by a device having the features of claim 1, and on the other hand by a method having the features of claim 11. Preferred embodiments of the invention are specified in the dependent claims.

The device according to the invention is characterized in that the guide tube is mounted on the retainer so as to be freely rotatable about the drilling axis, in that the clearing element is firmly attached to the rotatably mounted guide tube, in that, for the purpose of clearing, the guide tube is axially fixed in the direction of the drilling axis, and in that by means of a pulling procedure of the auger, the clearing element, together with the guide tube, can be caused to rotate about the drilling axis, for the purpose of clearing the auger.

A basic concept of the invention consists in mounting the guide tube, through which the auger penetrates, on the retainer so as to be freely rotatable. On account of the size of the guide tube, reliable and stable mounting on the retainer can be provided. The clearing element is fastened to the rotatably mounted guide tube, such that the clearing element is freely rotatable together with the guide tube. Within the meaning of the invention, "freely rotatable" means that no active rotating drive for rotating the clearing element is provided, but the clearing element can carry out a rotational movement during pulling, on account of an interaction with the screw geometry. The clearing element can be attached to the guide tube in a detachable and/or adjustable manner.

A further aspect of the invention consists in that, for clearing, the guide tube is axially stationary relative to the drilling axis. This can for example be achieved in that the retainer is fixed or firmly clamped to a mast of a drill. Overall, in this case, the device is designed such that the clearing element, which engages in the helix gap of the auger, is caused to rotate about the drilling axis, together with the guide tube, by means of a pulling procedure of the auger. The auger geometry, and in particular the geometry of the auger helix, converts an axial pulling movement of the auger into a rotating movement of the clearing element, together with the guide tube, about the drilling axis. Thus, in this case, an axial pulling movement and the rotating movement of the clearing element are automatically and passively matched to one another. In the case of the pulling movement of the auger, said auger can perform a certain rotating movement, or can also be stationary in the peripheral direction.

The invention thus makes it possible for reliable clearing of remaining ground material from an auger to be achieved with an overall simple and long-lasting design without complex control or energy supply of the clearing device.

A preferred embodiment of the invention consists in the clearing element comprising a clearing plate having a receiving slit in which the drill helix engages. The clearing plate encompasses the drill helix on the upper side and the underside, from the free edge, by means of the receiving slit. In this case, the clearing plate can be designed such that it extends, as a whole or over a substantial part of the radial dimension of the drill helix. This ensures a reliable wiping of the drill helix by the clearing plate, and stripping off the ground material.

According to a development of the device according to the invention, it is advantageous for the clearing plate to comprise a plate main body, on which at least one adjusting plate for forming the receiving slit is adjustably mounted. Preferably two adjusting plates are provided, which form an upper edge and a lower edge of the receiving slit. The adjustability of the adjusting plates on the plate main body makes it possible for a slit width to be freely adjusted and matched to the respective sheet thickness of the drill helix of an auger. The adjusting plates are preferably produced from a particularly wear-resistant material since these can rest on the drill helix and strip off the ground material.

In the event of excessive wear, the adjusting plates can also be easily detached and changed. Preferably, in order to hold the at least one adjusting plate, a screw connection comprising slotted holes is provided on the adjusting plate.

During clearing operation, the edges of the receiving slit of the clearing element can come into contact with the axially moving auger, such that a displacement, and thus a rotational movement, of the clearing element about the drilling axis is brought about on account of the pitch of the drill helix.

In order to improve the movement of the clearing element while matching the movement of the auger, according to a further embodiment variant of the invention it is provided for at least one guide roller, for resting on the drill helix of the auger, to be rotatably mounted on the clearing element. Preferably, in this case, the at least one guide roller is arranged on the clearing element in such a way that it comes to rest on an underside of the drill helix. In this case, the underside of the drill helix is the side which is opposite the upper side on which the ground material rests. Since in particular the drill helix is frequently not completely filled with ground material, a particularly gentle positioning of the guide roller is achieved in this way. This is further improved in that the guide roller is located behind the clearing plate, in a clearing direction, such that the guide roller itself does not come into contact, or barely comes into contact, with ground material. The guide roller serves as a type of cam roller, which, together with the drill helix, forms a kind of cam follower mechanism in order to convert the axial pulling movement of the auger into a rotating orbital movement of the clearing element and of the guide roller.

Furthermore, according to one embodiment of the invention particularly good mounting of the guide roller is achieved in that the retainer comprises an annular receptacle, at which the guide tube is rotatably mounted and received. The guide tube is thus rotatably mounted overleaf, over the entire periphery, such that both axial forces and transverse forces can be reliably absorbed. In principle, the guide tube is retained in a detachable and replaceable manner, such that in the case of the auger being changed, simple matching to a changed diameter can take place by replacing the guide tube.

In this case, it is particularly advantageous for a plurality of bearing rollers to be arranged on the annular receptacle, by means of which bearing rollers the guide tube is mounted on the retainer so as to be rotatable about the drilling axis and axially fixed with respect to the drilling axis. In this case, the bearing rollers are mounted on the retainer, in particular an inner face of the annular receptacle, in each case having a roller axis which is oriented radially with respect to the drilling axis. The bearing rollers are in particular designed as support rollers, wherein an upper annular web on the outer periphery of the guide tube rests on the bearing rollers. In order to prevent an axial displacement of the guide sleeve upwards, a lower annular web can furthermore be attached on the outer periphery of the guide roller sleeve. In this case, the upper and the lower annular web are spaced apart axially by an amount which approximately corresponds to the outside diameter of the transversely oriented bearing rollers. Bearing rollers arranged in this way are also referred to as tiger rollers.

A further advantageous embodiment of the invention consists in that the annular receptacle is formed having two pivot arms, which are mounted so as to be pivotable between a closed operating position, in which the pivot arms are pivoted together in order to form the annular receptacle, and are interconnected by means of a detachable connection means, and an open position, in which the pivot arms are pivoted apart from one another laterally. This allows for opening of the annular receptacle, such that for example the auger can be laterally removed and changed in a simplified manner. Furthermore, pivoting open the annular receptacle while drilling out the auger, in which a clearing device is not yet required, makes it possible to largely remove this from the work region. This makes it possible for the clearing device to not impede a movement of the drilling drive downwards along the mast, such that extensive movement of the drilling drive downwards along the mast towards the ground is made possible.

During subsequent pulling of the auger, the pivotably mounted pivot arms, on the retainer, can be pivoted together again in a simple manner, and rigidly interconnected again, using a suitable connection means, for example a locking bolt.

In this case, it is particularly advantageous for the guide tube to be separable for opening. Preferably, the guide tube can be opened in two half shells, wherein preferably each half shell is retained on a pivot arm. If necessary, the half shells can also be removed from the pivot arms or fixed on the pivot arms in the open state, by means of a separate fastening device. Suitable connecting means, such as tension clamps or screw connections, can also be provided on the guide tube, on the outer periphery, such that when the guide tube is closed, the two half shells are reliably interconnected again.

According to a development of the invention, it is expedient for the retainer to comprise a carriage guide for displaceable guidance along the mast of the drill, and a fixing means for fixing the retainer on the mast. In particular, the retainer can comprise a slide block, by means of which the retainer and the drill carriage are mounted on a mast, in particular a leader, so as to be displaceable along a guide. A displacement can take place in any suitable manner, for example by means of an adjust cylinder or a pulling cable. In particular clamps can be provided as the fixing means, which clamps can be actuated by hand or in an energy-operated manner.

The invention further comprises a drill having an undercarriage, an upper structure mounted thereon, and a mast, along which a drilling drive comprising a driven auger is displaceably mounted, wherein the above-described device according to the invention is arranged for clearing. In particular, the device is arranged on the drill, in the region of the mast. The drill can in particular be a pile drill, wherein the mast is arranged and mounted substantially vertically on a carrier device comprising an undercarriage and upper structure.

The invention furthermore includes a method for making a drilled hole in the ground, using the drill described above, wherein, in order to form the drilled hole, an auger is screwed into the ground and subsequently pulled out again. While the auger, which can in particular be an so-called endless auger, which extends substantially along the entire length of the mast, is being screwed in, ground material is removed, which can accumulate on the helical drill helix.

It is in accordance with the invention that, during pulling of the auger, remaining ground material is cleared from a helix gap of the auger by means of the device according to the invention described above. In this case, the method is carried out by means of the device described above, wherein the above-described advantages result.

Depending on the method, the bore made can preferably be filled, via a hollow stem of the auger, with a curable mass, in particular a concrete suspension, in order to form an augered or foundation pile.

Figure 2:
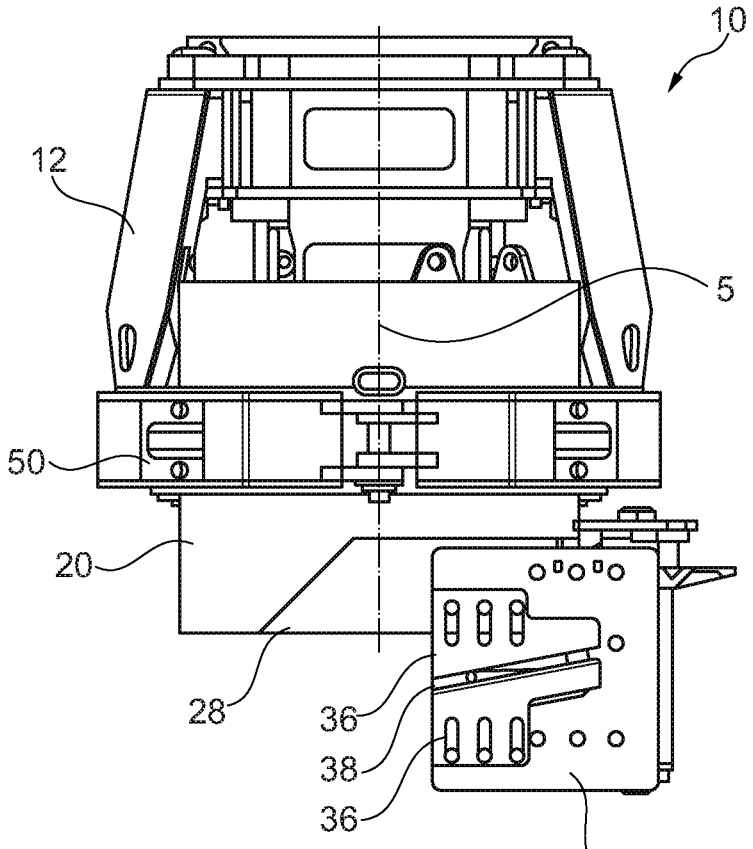
Figure 3:
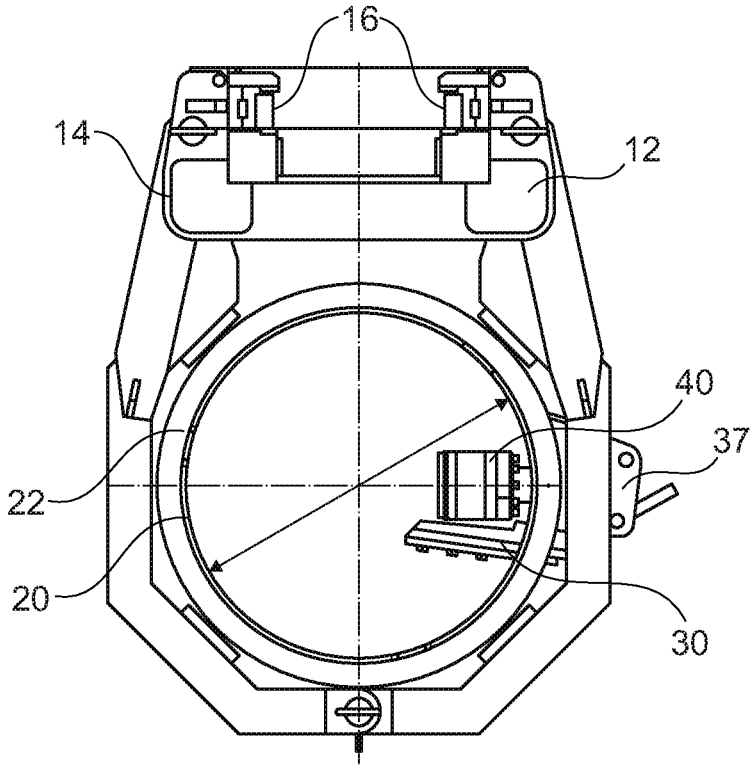

The invention is described in more detail in the following, with reference to a preferred exemplary embodiment which is shown schematically in the accompanying drawings. In the drawings show:

FIG. 1 a perspective view of a device according to the invention;

FIG. 2 a front view of the device of FIG. 1;

FIG. 3 a plan view, from above, of the device of FIGS. 1 and 2; and

Figure 4:
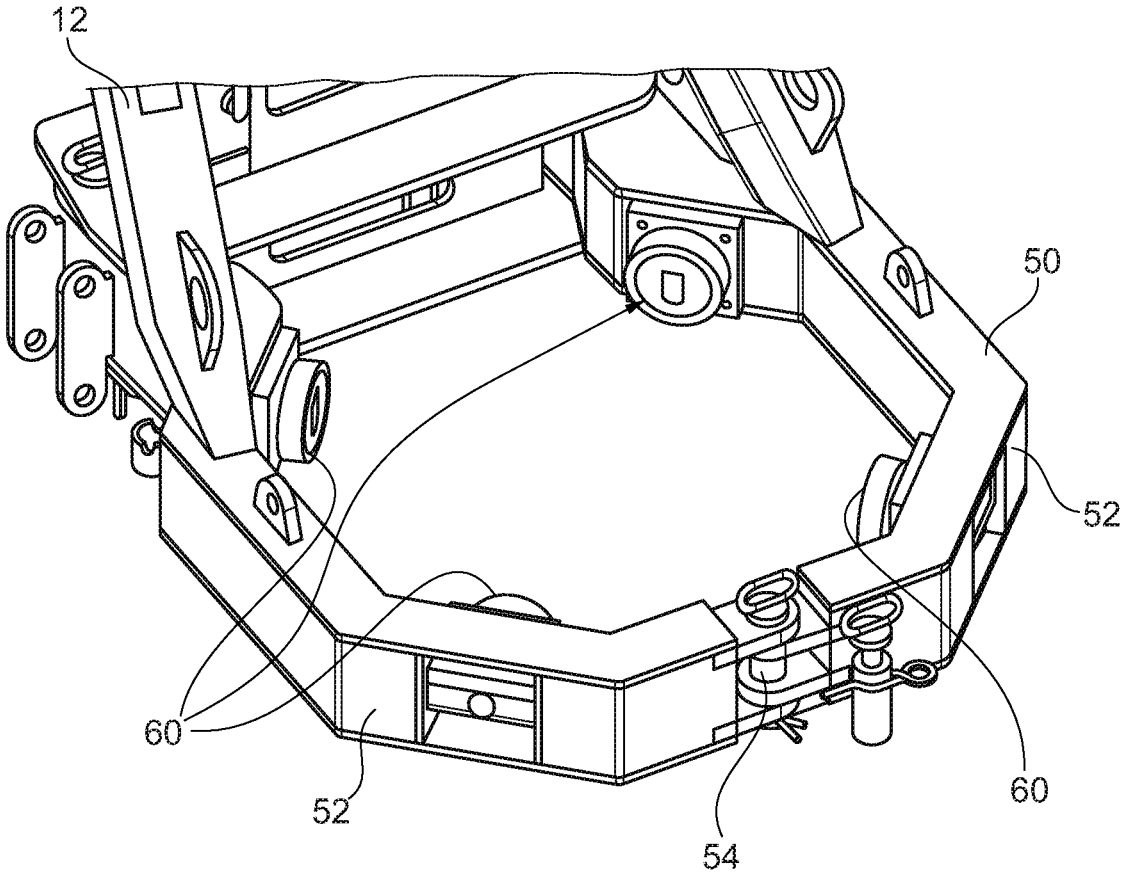

FIG. 4 a partial perspective view of the device according to FIGS. 1 to 3, with guide tube being removed.

As can be seen in FIGS. 1 to 3, a device 10 according to the invention for clearing a helix gap of an auger (not shown) comprises a retainer 12 having a carriage-like main body 14. In order to form a carriage guide 16, slide blocks are arranged on a rear face of the main body 14, by means of which blocks the retainer 12 can be displaceably guided and fixed along a linear guide on a mast, in particular a leader, of a drill. The carriage guide 16 can correspond to the guidance on a drilling drive on the mast of the drill.

On the front face thereof, the retainer 12 comprises an annular receptacle 50 which is typically arranged horizontally during operation, and which is formed by two pivot arms 52. The pivot arms 52 are in each case mounted, by means of a swivel joint 56, on the main body 14 and the retainer 12 so as to be pivotable between a closed operating position, which is shown in the drawings, and an open position in which the pivot arms 52 are in each case pivoted laterally outwards about the swivel joint 56. In the operating position, the pivot arms 52 are detachably connected via a connection means 54. In the exemplary embodiment shown, the connection means 54 comprises a vertically oriented locking bolt.

In the closed operating position of the annular receptacle 50, a guide tube 20 is received therein and is mounted so as to be rotatable about a vertically oriented drilling shaft 5. An inside diameter of the guide tube 20 is matched to an outside diameter of the auger (not shown), such that the auger is received in the guide tube 20 in a guiding and rotatable manner. The guide tube 20 can itself be separable into two parts, which is indicated schematically by an axially extending interstice 24 on the guide tube 20.

When the annular receptacle 50 is opened, the guide tube 20 can also be held and removed using a lifting equipment comprising hooks, wherein retaining lugs 26 for corresponding hooks of the lifting equipment are arranged on the upper side of the guide tube 20.

The guide tube 20 protrudes through the annular receptacle 50, wherein a clearing element 30 is fastened on a lower end of the guide tube 20 in a detachable and adjustable manner, by means of a clearing retainer 37. A plate main body 34 comprising a receiving slit 38 is provided on the clearing retainer 37. The receiving slit 38 is designed for laterally receiving a drill helix of the auger. For the purpose of matching to the geometry of the auger, a clearing plate 32 comprising upper and lower adjusting plates 36 is provided on the plate main body 34. For the purpose of adjusting the geometry and the width of the receiving slit, the upper and lower adjusting plates 36 are adjustably fastened by means of screw connections and corresponding slotted holes in the adjusting plates 36. The clearing retainer 37 can comprise a swivel joint, about which the clearing element 30 can be pivoted out of a clearing position in the auger and into a release position.

Furthermore, the clearing element 30 comprises a radially oriented guide roller 40, which is arranged and formed such that it comes to rest on an underside or upper side of the drill helix. In this case, the guide roller 40 can roll on the drill helix, such that, in the case of an axial pulling movement of the auger vertically upwards, on account of the pitch of the drill helix a force is exerted, in the peripheral direction, on the clearing element 30 and thus on the rigidly connected guide tube 20.

In this case, according to the invention the guide tube 20 is mounted so as to be rotatable about the typically vertically oriented drilling axis 5. For this purpose, the guide tube 20 comprises two annular webs 22 on the outer side thereof, wherein in FIGS. 1 and 3 only the upper annular web 22 is visible in each case. By means of the upper annular web 22, the guide tube 22 rests on radially oriented bearing rollers 60, on an inner face of the annular receptacle 50, wherein the bearing rollers 60 are shown in FIG. 4. In the exemplary embodiment shown, in each case two bearing rollers 60 are arranged on one of the two pivot arms 52, respectively, having a radially oriented rolling axis. On the guide tube 20, the lower annular web is thus spaced apart, axially downwards, from the upper annular web 22 by an amount which approximately corresponds to the diameter of the bearing rollers 60, such that the guide tube 20 is received in the annular receptacle 50 so as to be rotatable, but axially fixed.

On account of the described geometry, in the case of axial pulling of the auger having a certain screw pitch, a force can be exerted on the clearing element 30 by the guide roller 40, such that the guide tube 20, having the attached clearing element 30 and mounted so as to be freely rotatable, is set into a revolving movement about the drilling axis 5. In this case, the clearing plate 32, which engages in a drill helix gap of the auger, smears said region and can thus strip off ground material remaining on the auger helix.

In order to facilitate the ejection of the ground material via the clearing plate 32, which is matched to the helix gap with respect to the radial and axial dimensions, a recess 28 for ejecting the ground material is provided in a lower region of the guide tube 20.

The invention claimed is:

1. A device for clearing a helix gap of an auger, comprising a retainer for holding the device on a mast of a drill, a guide tube which surrounds the auger, with a drill helix, in portions and is mounted on the retainer, and a clearing element which extends into the helix gap in a clearing position and is mounted on the retainer so as to be freely rotatable about a drilling axis, wherein the guide tube is mounted on the retainer so as to be freely rotatable about the drilling axis, the clearing element is firmly attached to the guide tube, for clearing, the guide tube is axially fixed in the direction of the drilling axis, and wherein, when in the clearing position, the clearing element, together with the guide tube, is configured to be caused to rotate about the drilling axis by pulling the auger along the drilling axis, for the purpose of clearing the auger, characterized in that the clearing element comprises a clearing plate having a receiving slit in which the drill helix is received in the clearing position.

2. The device according to claim 1, wherein the clearing plate surrounds an upper side and an underside of the drill helix, from the free edge of the drill helix, by means of the receiving slit.

3. The device according to claim 2, wherein the clearing plate comprises a plate main body, on which at least one adjusting plate is adjustably mounted, in order to form the receiving slit.

4. The device according to claim 1, wherein at least one guide roller for resting on a drill helix of the auger is rotatably mounted on the clearing element.

5. The device according to claim 1, wherein the retainer comprises an annular receptacle on which the guide tube is rotatably mounted and received.

6. The device according to claim 5, wherein a plurality of bearing rollers is arranged on the annular receptacle, by means of which rollers the guide tube is mounted on the retainer so as to be rotatable about the drilling axis and axially fixed with respect to the drilling axis.

7. The device according to claim 5, wherein the annular receptacle is formed having two pivot arms, which are mounted so as to be pivotable between a closed operating position, in which the pivot arms are pivoted together in order to form the annular receptacle and are interconnected by means of a detachable connection means, and an open position, in which the pivot arms are pivoted apart from one another laterally.

8. The device according to claim 1, wherein the guide tube is separable for the purpose of opening.

9. The device according to claim 1, wherein the retainer comprises a carriage guide for displaceable guidance along the mast of the drill, and a fixing means for fixing the retainer on the mast.

10. A drill comprising an undercarriage, an upper structure mounted thereon, and a mast, along which a drilling drive comprising the auger is displaceably mounted, wherein the device according to claim 1 is arranged along the mast.

11. A method for making a drilled hole in the ground using the drill according to claim 10, wherein the auger is used for forming the drilled hole and is screwed into the ground and subsequently drawn again, wherein during pulling of the auger, remaining ground material is cleared from the helix gap of the auger by means of the device.

* * * * *